US006606871B2

(12) United States Patent
Butcher et al.

(10) Patent No.: US 6,606,871 B2
(45) Date of Patent: Aug. 19, 2003

(54) TWINNING INTERFACE CONTROL BOX KIT FOR TWINNED FAN COILS IN DUAL HEAT PUMP OR AC SYSTEM

(75) Inventors: Ronald G. Butcher, Plainfield, IN (US); Don A. Schuster, Lindale, TX (US)

(73) Assignee: Carrier Corporation, Farmington, CT (US)

( * ) Notice: Subject to any disclaimer, the term of this patent is extended or adjusted under 35 U.S.C. 154(b) by 73 days.

(21) Appl. No.: 09/944,813

(22) Filed: Aug. 31, 2001

(65) Prior Publication Data

US 2003/0041605 A1 Mar. 6, 2003

(51) Int. Cl.[7] ..... F25B 49/02
(52) U.S. Cl. ..... 62/175; 62/298
(58) Field of Search ..... 62/298, 77, 175, 62/160; 236/51

(56) References Cited

U.S. PATENT DOCUMENTS 4,763,485 A * 8/1988 Sparks ..... 62/298 X
5,039,009 A * 8/1991 Baldwin et al. ..... 62/298 X
5,237,826 A * 8/1993 Baldwin et al. ..... 62/77
5,316,073 A 5/1994 Klaus et al. ..... 165/11.1
5,570,586 A * 11/1996 Maciulewicz ..... 62/175
5,623,836 A * 4/1997 Mrozinsky et al. ..... 62/298 X

* cited by examiner

*Primary Examiner*—Harry B. Tanner
(74) *Attorney, Agent, or Firm*—Wall Marjama & Bilinski LLP

(57) ABSTRACT

A control box kit for twinning fan coils in a heat pump or AC installation includes electro-mechanical isolation relays and auxiliary limit switches. Existing fan coil transformers are disconnected to avoid component failure due to high voltage wiring variations. A single transformer is connected to operate both systems. Isolation relays for the reversing valves and supplemental electric heaters in a heat pump system allow both heat pumps to have independent defrost cycles. The accessory transformer and isolation relays are packaged and pre-wired in a control box for easy connection in the field.

26 Claims, 7 Drawing Sheets

| | | | |
|---|---|---|---|
| FC1 | FAN COIL 1 | R1 | HN65KJ016 RELAY |
| FC2 | FAN COIL 2 | R2 | HN65KJ016 RELAY |
| FC1-CB | FAN COIL 1 CIRCUIT BOARD | R3 | P283-0346 RELAY |
| FC2-CB | FAN COIL 2 CIRCUIT BOARD | TRANS | HT01BD236 TRANSFORMER (230/24 75VA) |
| HP1 | HEAT PUMP 1 | CB | HH83ZB001 CIRCUIT BREAKER |
| HP2 | HEAT PUMP 2 | ALS1 | HH12HA142 AUXILLARY LIMIT SWITCH FAN COIL 1 |
| LEGEND | | ALS2 | HH12HA142 AUXILLARY LIMIT SWITCH FAN COIL 2 |

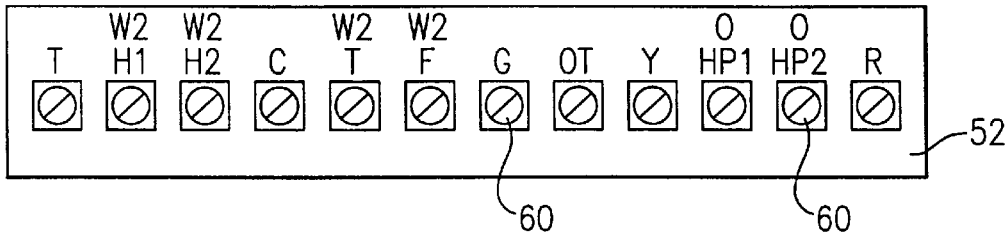

LEGEND:

| | |
|---|---|
| T | 24 VOLTS UNFUSED FROM TRANSFORMER |
| W2H1 | ENERGIZES RELAY 1 DURING HEAT PUMP 1 DEFROST CYCLE |
| W2H2 | ENERGIZES RELAY 2 DURING HEAT PUMP 2 DEFROST CYCLE |
| C | 24 VOLTS COMMON FROM TRANSFORMER |
| W2T | ENERGIZES SUPPLEMENTAL HEAT FROM T'STAT |
| W2F | CONNECTS FAN COIL W2 TO RELAY ONE AND RELAY 2 NORMALLY CLOSED CONTACTS |
| G | ENERGIZES BOTH FAN COIL BLOWER MOTORS |
| OT | ENERGIZES RELAY 3 WHICH ENERGIZES HP1 AND HP2 REVERSING VALVES |
| Y | ENERGIZES CONTACTOR IN HP1 AND HP2 |
| O HP1 | CONNECTS RELAY 3 TO HP1 REVERSING VALVE |
| O HP2 | CONNECTS RELAY 3 TO HP2 REVERSING VALVE |
| R | 24 VOLTS FUSED FROM TRANSFORMER |

FIG.8

TWINNING INTERFACE CONTROL BOX KIT FOR TWINNED FAN COILS IN DUAL HEAT PUMP OR AC SYSTEM

FIELD OF THE INVENTION

This invention relates generally to the field of kits for heating and cooling systems, and more particularly to a control box kit for twinning operation of a heating, cooling, or heat pump system.

BACKGROUND OF THE INVENTION

In a typical heating or cooling system, a controller or control circuit connects a thermostat to a heating or cooling device. The thermostat initiates a demand for heating or cooling which signals the heating/cooling device to turn on and off. The controller or control circuit receives the signal from the thermostat and controls the action of the heating/cooling device. Such heating/cooling devices include furnaces, air conditioners, combined furnace/air conditioner systems which share an air handling system, and heat pumps.

Heat pump systems use a refrigerant to carry thermal energy between a relatively hotter side of a circulation loop to a relatively cooler side of the circulation loop. Compression of the refrigerant occurs at the hotter side of the loop, where a compressor raises the temperature of the refrigerant. Evaporation of the refrigerant occurs at the cooler side of the loop, where the refrigerant is allowed to expand, thus resulting in a temperature drop. Thermal energy is added to the refrigerant on one side of the loop and extracted from the refrigerant on the other side, due to the temperature differences between the refrigerant and the indoor and outdoor mediums, respectively, to make use of the outdoor mediums as either a thermal energy source or a thermal energy sink. In the case of an air to water heat pump, outdoor air is used as a thermal energy source while water is used as a thermal energy sink.

The process is reversible, so the heat pump can be used for either heating or cooling. Residential heating and cooling units are bidirectional, in that suitable valve and control arrangements selectively direct the refrigerant through indoor and outdoor heat exchangers so that the indoor heat exchanger is on the hot side of the refrigerant circulation loop for heating and on the cool side for cooling. A circulation fan passes indoor air over the indoor heat exchanger and through ducts leading to the indoor space. Return ducts extract air from the indoor space and bring the air back to the indoor heat exchanger. A fan likewise passes ambient air over the outdoor heat exchanger, and releases heat into the open air, or extracts available heat therefrom.

In many cases, it is more cost effective or practical to install two residential-type units of moderate capacity than one commercial-type unit of large capacity. Twinned units typically operate off one thermostat. In a one-stage twinned system, both units turn on and off simultaneously. In a two-stage or multi-stage twinned system, the two units cycle separately in a prescribed manner.

Under certain operating conditions, frost builds up on a coil of the heat pump. Coil frosting results in lower coil efficiency while affecting the overall performance (heating capacity and coefficient of performance (COP)) of the unit. From time to time, the coil must be defrosted to improve the unit efficiency. In a twinned system, defrosting both units simultaneously is inefficient.

U.S. Pat. No. 5,316,073 discloses a twinning control for use on HVAC systems which is based on a microprocessor with LED indicators. Although such a control system works, the relative low volume of twinned fan coil installations does not justify developing a microprocessor based system. Making individual hand connections between thermostats, relays, fan coils, and heating/cooling units is cumbersome and time consuming.

SUMMARY OF THE INVENTION

Briefly stated, a control kit for twinning fan coils in a heat pump or AC installation includes electro-mechanical isolation relays and auxiliary limit switches. Existing fan coil transformers are disconnected to avoid component failure due to high voltage wiring variations. A single transformer is connected to operate both systems. Isolation relays for the reversing valves and supplemental electric heaters in a heat pump system allow both heat pumps to have independent defrost cycles. The accessory transformer and isolation relays are packaged and pre-wired in a control box for easy connection in the field. The accessory limit switches are integral safety devices to assure safe operation in the case of improper fan coil operation in heating mode.

According to an embodiment of the invention, a control box kit for twinning first and second units of an HVAC system, wherein the first and second units are either first and second air conditioning units or first and second heat pump units, and the system includes first and second fan coils and a thermostat, includes a control box; a single transformer which provides low voltage power to both of the units, the transformer disposed inside the control box; and connection wires inside the control box pre-wired for a preselected twinned-unit operating configuration such that an installer makes all field connections for the preselected twinned-unit operating configuration between the thermostat, the first and second fan coils, and the first and second units to the connection wires.

According to a feature of the invention, the preselected twinned-unit operating configurations include (a) single-stage operation of the first and second heat pump units; (b) multi-stage operation of the first and second heat pump units; (c) single-stage operation of the first and second air conditioning units; and (d) multi-stage operation of the first and second air conditioning units.

According to a feature of the invention, the control box kit further includes a terminal strip attached to the control box, the terminal strip having a plurality of terminal posts extending from outside the control box to inside the control box, wherein the connection wires are connected to the terminal posts inside the control box, and the field connections are made at the terminal strip outside the control box.

BRIEF DESCRIPTION OF THE DRAWINGS

FIG. 8 shows a terminal strip used with the control box of FIGS. 5–7 to implement the wiring configurations of FIGS. 1–4.

DETAILED DESCRIPTION OF THE PREFERRED EMBODIMENT

The following nomenclature is used for the thermostat, fan coil, and heat pump connection terminals in FIGS. 1–4.

| | |
|---|---|
| R | 24-volt hot lead from transformer (fused) |
| C | 24 volt common lead from transformer |
| G | Energizes indoor blower motor |
| Y/Y2 or Y | Energizes outdoor unit contactor which controls compressor and fan motor |
| W/W1 or W2 | Energizes first stage heat on non-heat pump systems or second stage heat on heat pump systems |
| O | Energizes reversing valve on heat pumps only |
| T1 | 24-volt hot lead from transformer (non-fused) |

Figure 1:
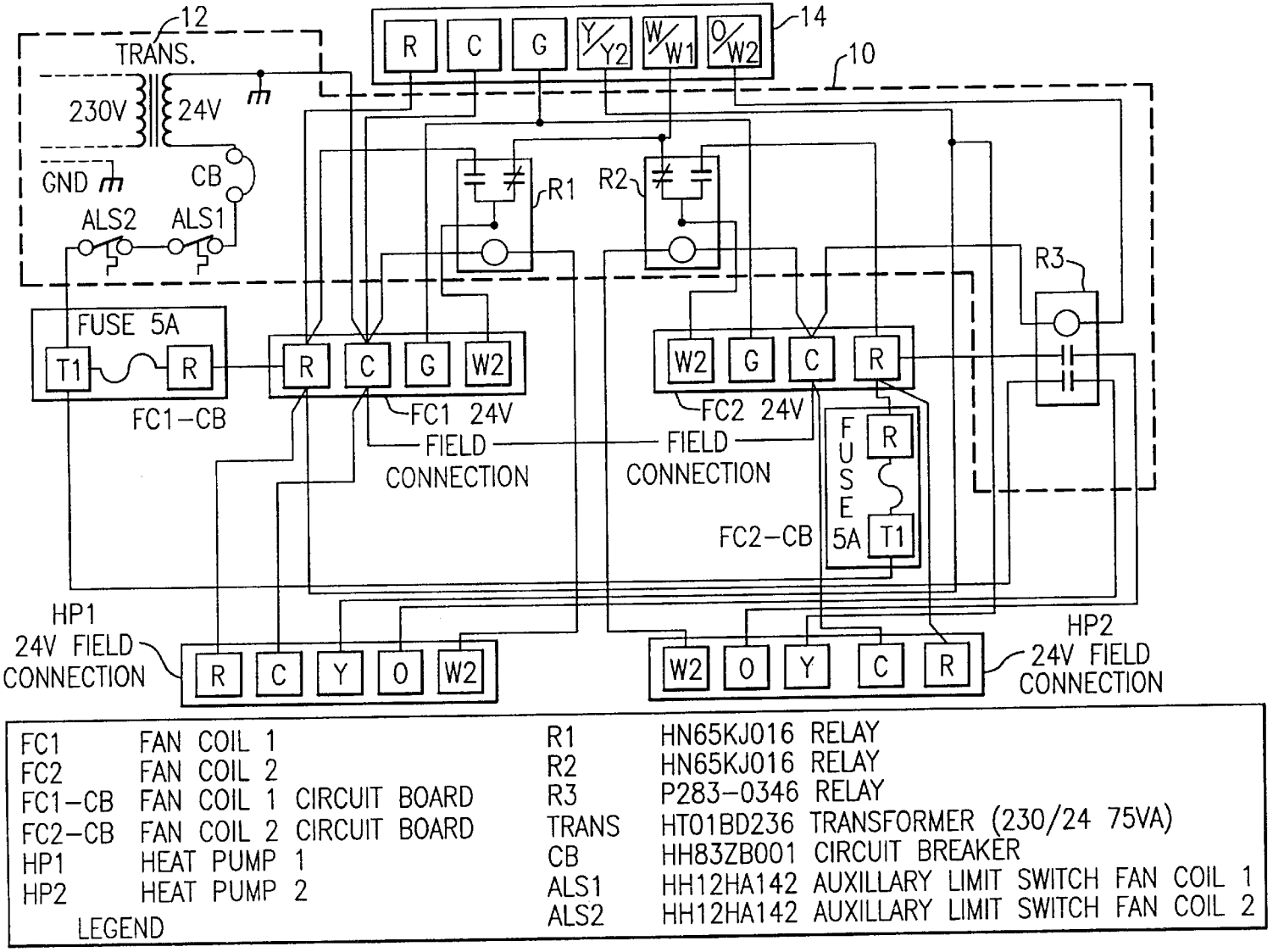
FIG. 1 shows a wiring configuration for twinned heat pumps with single stage operation.

Referring to FIG. 1, a single-stage control diagram for a twinned heat pump system is shown. The system includes two heat pumps, one thermostat, and two indoor fan coils. In single-stage operation, both heat pumps turn on and off at the same time.

In one embodiment, a control system kit 10 is in kit form with all connections between a transformer 12 and relays R1, R2, and R3 already made. Wires for connections to a thermostat 14, fan coils FC1, FC2, and heat pumps HP1, HP2 are preferably part of control system kit 10 and either labeled or color coded. The connections to thermostat 14, fan coils FC1, FC2, and heat pumps HP1, HP2 are made in the field by an installer. Thermostat 14 is preferably capable of at least one stage cooling and two stage heating, such as the Carrier Corporation Model TSTATCCNHP01-B.

The sequence of operation for the single-stage system of FIG. 1 is as follows. In the cooling mode, thermostat 14 connects R to O which energizes relay R3. The normally open contacts of relay R3 close, thus energizing reversing valves (not shown) in heat pumps HP1 and HP2. Thermostat 14 connects R to Y/Y2, energizing the contactor in each heat pump HP1, HP2 via the Y connections. Thermostat 14 connects R to G, thus energizing the blower motor in each indoor fan coil FC1, FC2. In heating mode, thermostat 14 connects R to Y/Y2, energizing the contactor in each heat pump HP1, HP2 via the Y connections. If the temperature in the space being heated continues to fall, thermostat 14 connects R to W/W1, energizing the electric heat relays via the normally closed contacts of relays R1 and R2. Each heat pump HP1 and HP2 can enter defrost mode independently. A fixed or variable differential is preferably built into thermostat 14 between stages. In fan only mode, thermostat 14 connects R to G, energizing the blower motor in each indoor fan coil FC1, FC2.

Figure 2:
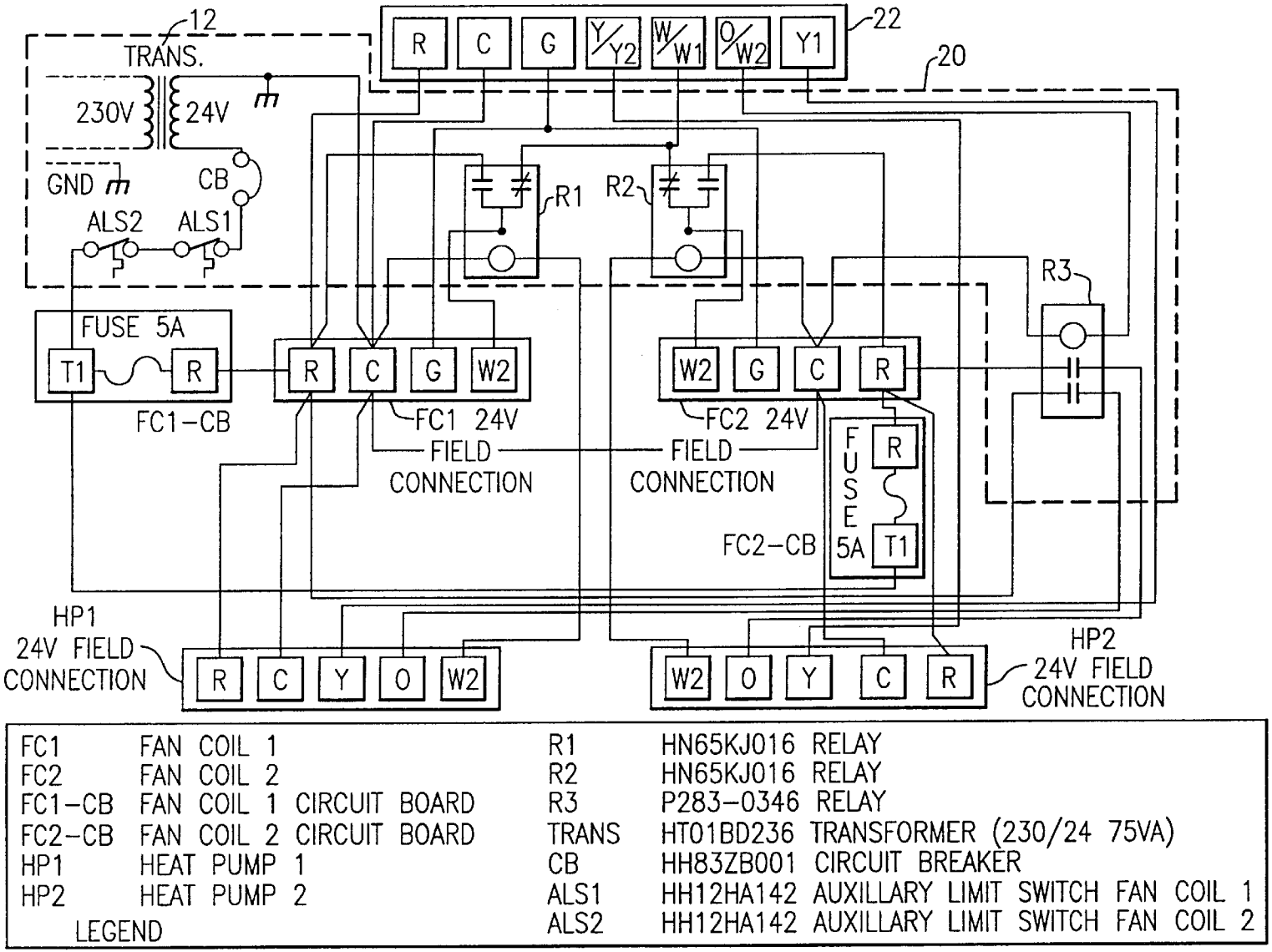
FIG. 2 shows a wiring configuration for twinned heat pumps with multi-stage operation.

Referring to FIG. 2, a multi-stage control diagram for a twinned heat pump system is shown. The system includes two heat pumps, one thermostat, and two indoor fan coils. In one embodiment, a control system kit 20 is in kit form with all connections between a transformer 12 and relays R1, R2, and R3 already made. Wires for connections to a thermostat 22, fan coils FC1, FC2, and heat pumps HP1, HP2 are preferably part of control system kit 20 and either labeled or color coded. The connections to thermostat 22, fan coils FC1, FC2, and heat pumps HP1, HP2 are made in the field by an installer. Thermostat 22 is preferably capable of two stages of cooling and three stages of heating, such as the Carrier Corporation Model TSTATCCN2S01-B.

The sequence of operation for the multi-stage system of FIG. 2 is as follows. In cooling mode, thermostat 22 connects R to O energizing relay R3. The two normally open contacts of relay R3 close, energizing the reversing valve in each heat pump HP1, HP2. Thermostat 22 connects R to Y1, energizing the contactor in heat pump HP1, i.e., first stage cooling. Thermostat 22 connects R to G energizing the blower motor in each indoor fan coil FC1, FC2. If the temperature in the conditioned space continues to rise, thermostat 14 connects R to Y/Y2 which energizes the contactor in HP2, i.e., second stage cooling. A fixed or variable differential is preferably built into thermostat 14 between stages. In heating mode, first stage, thermostat 22 connects R to Y1, energizing the contactor in heat pump HP1. Thermostat 22 connects R to G energizing the blower motor in each indoor fan coil FC1, FC2. If the temperature continues to fall in the conditioned space while operating in first stage heating, thermostat 14 connects R to Y/Y2 which energizes the contactor in heat pump HP2, i.e., second stage heating. A fixed or variable differential is preferably built into thermostat 22 for all stages. In heating mode, third stage, thermostat 22 connects R to W/W1. 24 volts from W/W1 is fed through the normally closed contacts of relays R1 and R2 to both W2 terminals of fan coils FC1, FC2. The electric heat relays are energized bringing on supplemental heat. Note that in first stage heating, one heat pump and both indoor fan coils are operating. Entering second stage heating adds the second heat pump, while entering third stage heating adds the supplemental heat source.

In the defrost mode for heat pump HP1, the defrost control in heat pump HP1 energizes the reversing valve when defrost is needed. The defrost control also sends 24 volts to the W2 terminal of heat pump HP1 and to relay R1. Relay R1 is energized, thus closing its normally open contacts and opening its normally closed contacts. 24 volts is fed from R to the W2 terminal of fan coil FC1. The electric heat relay is energized bringing on supplemental heat during defrost. In the defrost mode for heat pump HP2, the defrost control in heat pump HP2 energizes the reversing valve when defrost is needed. The defrost control also sends 24 volts to the W2 terminal of heat pump HP2 and to relay R2. Relay R2 is energized, thus closing its normally open contacts and opening its normally closed contacts. 24 volts is fed from R to terminal W2 terminal of fan coil FC2. The electric heat relay is energized bringing on supplemental heat during defrost. Each heat pump HP1 and HP2 can enter defrost mode independently.

In fan only mode, thermostat 22 connects R to G energizing the blower motor in each indoor fan coil FC1, FC2.

Figure 3:
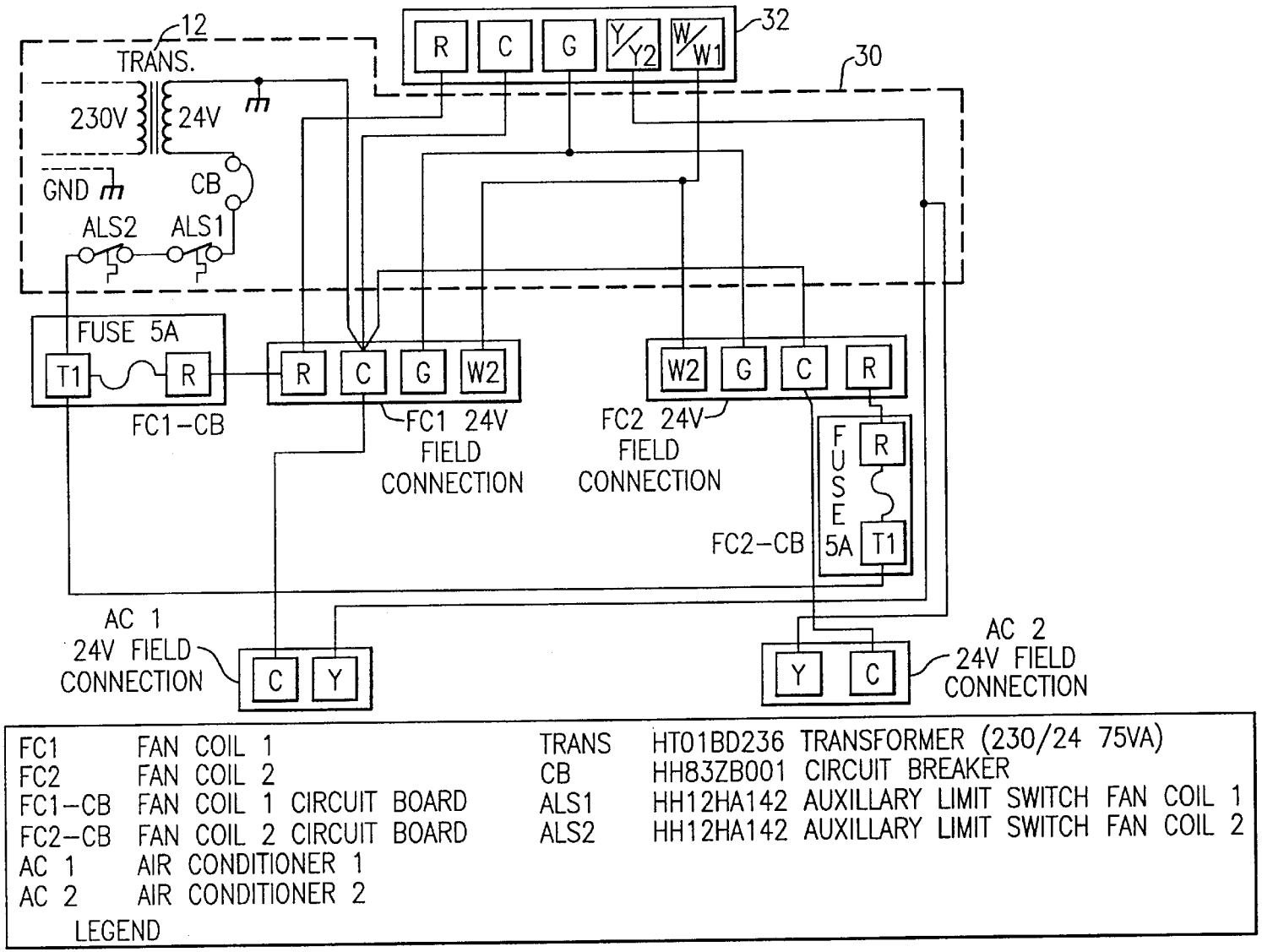
FIG. 3 shows a wiring configuration for twinned air conditioners with single stage operation.

Referring to FIG. 3, a single-stage control diagram for a twinned air conditioner system is shown. The system includes two air conditioners, one thermostat, and two indoor fan coils. In single-stage operation, both air conditioners turn on and off at the same time. In one embodiment, a control system kit 30 is in kit form with all internal kit connections already made. Kit 30 preferably includes a transformer 12. Wires for connections to a thermostat 32, fan coils FC1, FC2, and air conditioners AC1, AC2 are preferably part of control system kit 30 and either labeled or color coded. The connections to thermostat 32, fan coils FC1, FC2, and air conditioners AC1, AC2 are made in the field by an installer. Thermostat 32 is preferably capable of at least one stage of cooling and heating, such as the Carrier Corporation Model TSTATCCNAC01-B.

The sequence of operation for the single-stage system of FIG. 3 is as follows. In the cooling mode, thermostat 32 connects R to Y/Y2, energizing the contactor in each air conditioner AC1, AC2 via the Y connections. Thermostat 14 connects R to G, thus energizing the blower motor in each indoor fan coil FC1, FC2. If, as is common, air conditioners AC1, AC2 are part of a heating/cooling system that includes resistance heating (or hot water heat), the system is capable of going into heating mode. In heating mode, thermostat 32 connects R to W/W1, energizing the electric heat (via W2) in each fan coil FC1, FC2. In fan only mode, thermostat 14 connects R to G, energizing the blower motor in each indoor fan coil FC1, FC2.

Figure 4:
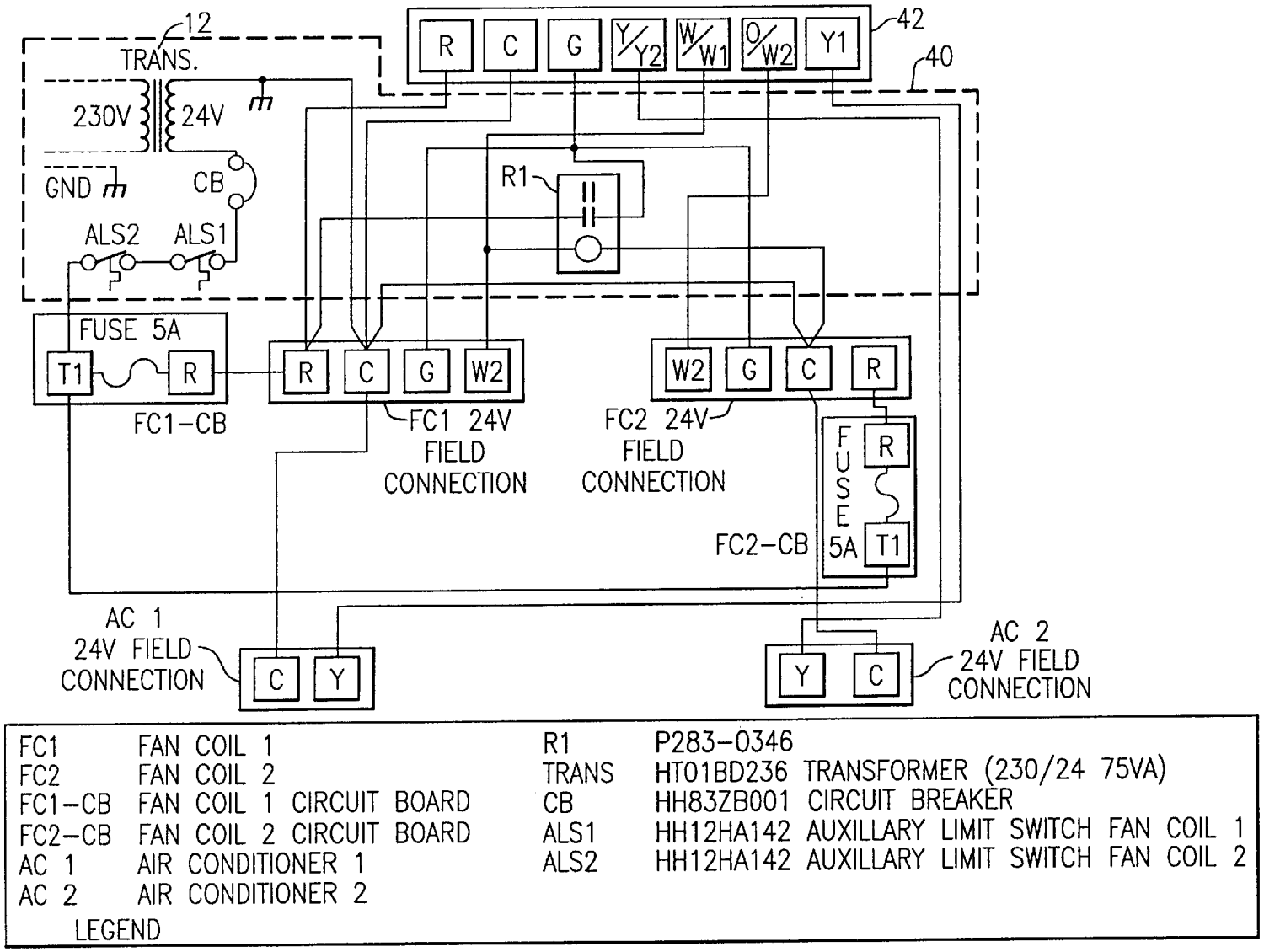
FIG. 4 shows a wiring configuration for twinned air conditioners with multi-stage operation.

Referring to FIG. 4, a multi-stage control diagram for a twinned air conditioner system is shown. The system includes two air conditioners, one thermostat, and two indoor fan coils. In one embodiment, a control system kit 40 is in kit form with all internal kit connections already made. Kit 40 preferably includes a transformer 12. Wires for connections to a thermostat 42, fan coils FC1, FC2, and air conditioners AC1, AC2 are preferably part of control system kit 40 and either labeled or color coded. The connections to thermostat 42, fan coils FC1, FC2, and air conditioners AC1, AC2 are made in the field by an installer. Thermostat 42 is preferably capable of two stages of cooling and two stages of heating, such as the Carrier Corporation Model TSTATCCN2S01-B.

The sequence of operation for the multi-stage system of FIG. 4 is as follows. In cooling mode, first stage, thermostat 42 connects R to Y1, energizing the contactor in air conditioner AC1. Thermostat 42 connects R to G energizing the blower motor in each indoor fan coil FC1, FC2. If the temperature continues to rise in the conditioned space while operating in first stage cooling, the system enters cooling mode, second stage. A fixed or variable differential is preferably built into thermostat 42 between stages. In cooling mode, second stage, thermostat 42 connects R to Y/Y2, energizing the contactor in air conditioner AC2. Note that in first stage cooling, one air conditioner and both indoor fan coils are operating, while entering second stage cooling adds the second air conditioner. If, as is common, air conditioners AC1, AC2 are part of a heating/cooling system that includes resistance heating (or hot water heat), the system is capable of going into heating mode. In heating mode, thermostat 42 connects R to W/W1 which energizes the electric heat relay in FC1. W/W1 also energizes relay R1 which connects R to G via R1 contacts, thus energizing blower motors in fan coils FC1 and FC2. If the temperature continues to fall in the conditioned space while operating in first stage heating, thermostat 42 connects R to O/W2, energizing the electric heat relay (via W2) in fan coil FC2. In fan only mode, thermostat 42 connects R to G energizing the blower motor in each indoor fan coil FC1, FC2.

In the embodiments of FIGS. 1–4, auxiliary limit switches ALS1 and ALS2 are shown in series between transformer 12 and R. Primary limit switches are conventionally part of an HVAC system which provides heating. In the event of blower failure and the consequent heat buildup, the primary limit switches trip due to the excessive heat. Typically, primary limit switches automatically reset when the temperature drops. During twinned operation, however, if blower failure occurs in one fan coil but not the other, it is possible that recirculation of air from the second fan coil is sufficient to keep the primary limit switch from tripping. Therefore, as an additional safety precaution, auxiliary limit switches ALS1 and ALS2 are attached to the respective blower housings. Auxiliary limit switches ALS1 and ALS2 are preferably manual reset switches instead of automatic reset switches.

Figure 5:
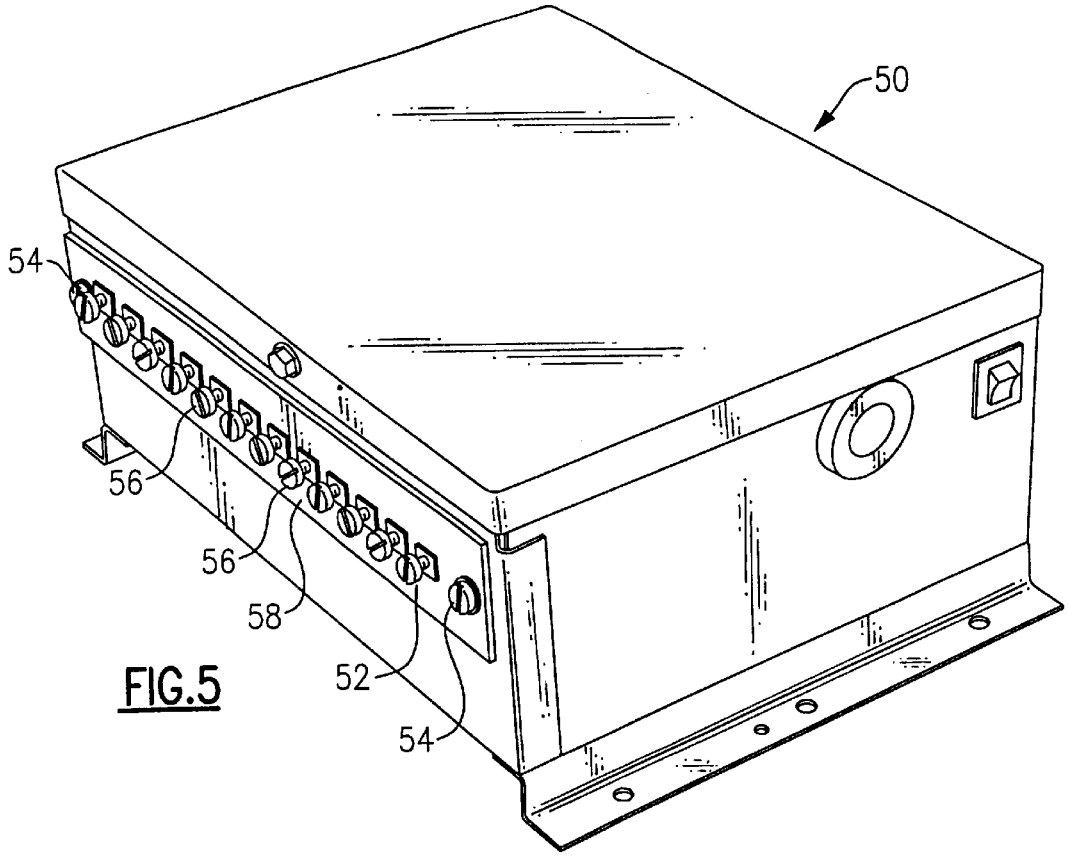
FIG. 5 shows a perspective view of a control box used with the wiring configurations of FIGS. 1–4.
Figure 6:
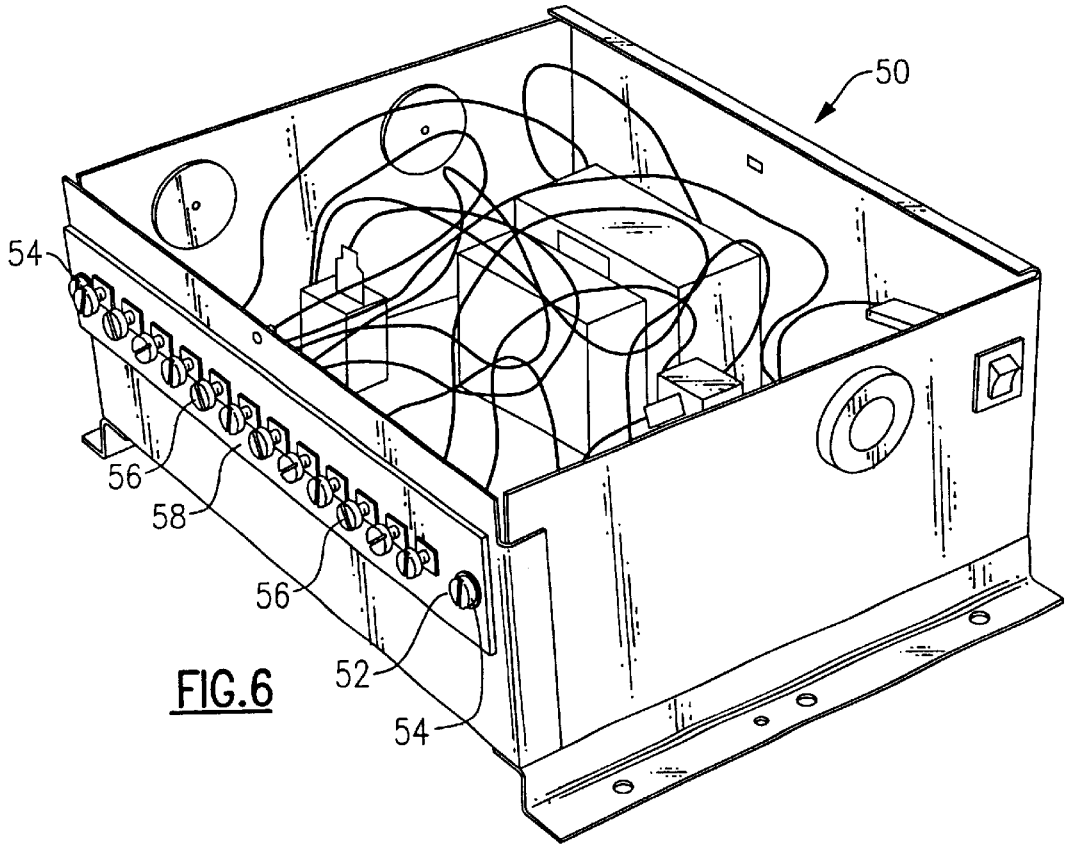
FIG. 6 shows a perspective view of a control box, with the lid removed, used with the wiring configurations of FIGS. 1–4.
Figure 7:
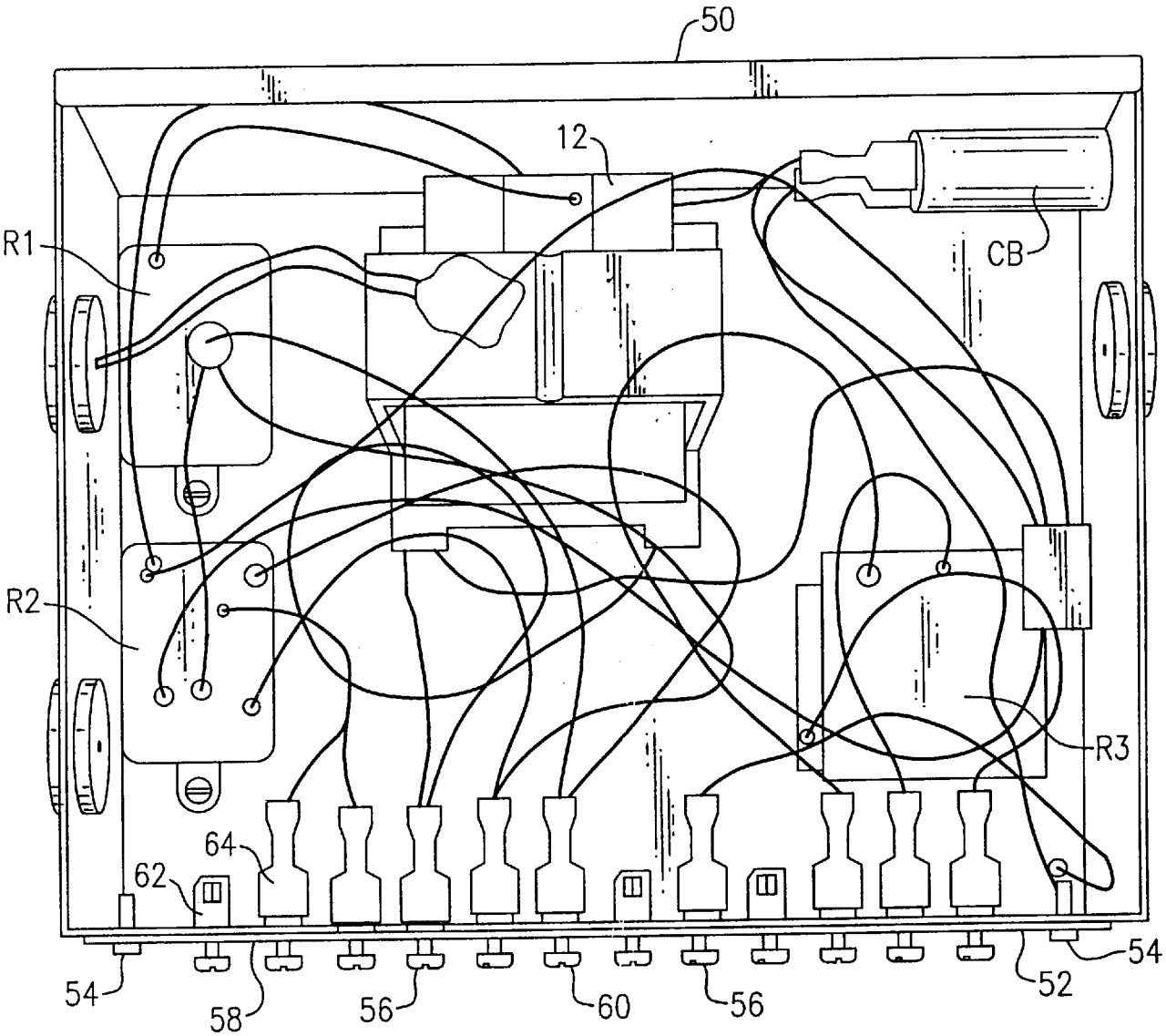
FIG. 7 shows a top view of a control box, with the lid removed, used with the wiring configurations of FIGS. 1–4.

Referring to FIGS. 5–7, a control box 50 is preferably of metal. Transformer 12, circuit breaker CB, and relays R1, R2, and R3 are shown mounted into control box 50. A portion of the front panel of control box 50 is cut away, permitting a terminal strip 52 to be fastened to control box 50 by a pair of fasteners such as screws 54. Terminal strip 52 includes a plurality of terminal posts 56 held in place by a non-conductive plate 58. Each terminal post 56 preferably includes a screw post 60 on one end and either one or two standard male terminal blade connectors 62 on the other. The wires from control system kits 10, 20, 30, 40 preferably are terminated with female terminal connectors 64 to facilitate attachment to terminal posts 56. The wires shown in FIGS. 5–7 are for illustrative purposes only and are not intended to reflect any particular wiring arrangement.

Referring to FIG. 8, each of the screw posts 60 of terminal strip 52 are preferably labeled with the external connections to be made. An example of standardized labels are shown, along with a legend, which correspond to the legends of FIGS. 1–4. The field installer affixes control box 50 in any suitable location within a cabinet of the system being installed, but preferably to one of the fan coils in a suitable location, and runs wires from terminal strip 52 to the thermostat, indoor fans, heat pumps, and/or air conditioners as necessary to implement one of the configurations of FIGS. 1–4. The wires necessary for the field installation external of control box 50 are optionally packaged along with control box 50.

In an alternative embodiment, the transformer, relays, and terminal connectors are mounted on a printed circuit board (PCB), with all the wiring incorporated into the PCB traces.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A control box kit for twinning first and second units of an HVAC system, wherein said first and second units are either first and second air conditioning units or first and second heat pump units, and said system includes first and second fan coils and a thermostat, comprising:

a control box;

a single transformer which provides low voltage power to both of said units, said transformer disposed inside said control box; and connection wires inside said control box pre-wired for a preselected twinned-unit operating configuration such that an installer makes all field connections for said preselected twinned-unit operating configuration between said thermostat, said first and second fan coils, and said first and second units to said connection wires.

2. A control box kit according to claim 1, further comprising a terminal strip attached to said control box, said terminal strip having a plurality of terminal posts extending from outside said control box to inside said control box, wherein said connection wires are connected to said terminal posts inside said control box, and said field connections are made at said terminal strip outside said control box.

3. A control box kit according to claim 2, wherein said preselected twinned-unit operating configurations include:

(a) single-stage operation of said first and second heat pump units;

(b) multi-stage operation of said first and second heat pump units;

(c) single-stage operation of said first and second air conditioning units; and (d) multi-stage operation of said first and second air conditioning units.

4. A control box kit according to claim 2, wherein said terminal posts extending outside said control box are in a set configuration such that said set configuration remains constant irrespective of which twinned-unit operating configuration is installed.

5. A control box kit according to claim 2, wherein said terminal posts extending outside said control box are in a set configuration such that said set configuration remains constant irrespective of which twinned-unit operating configuration is installed.

6. A control box kit according to claim 2, wherein said first and second units are first and second heat pump units, and said control box kit further includes first, second, and third relays pre-wired with said connection wires inside said control box.

7. A control box kit according to claim 6, wherein said relays and said connection wires are included on a printed circuit board.

8. A control box kit according to claim 6, wherein said thermostat is a single-stage thermostat.

9. A control box kit according to claim 6, wherein said thermostat is a multi-stage thermostat.

10. A control box kit according to claim 2, further comprising first and second auxiliary limit switches in said first and second fan coils, respectively, wherein activation of one of said first and second auxiliary limit switches interrupts power from said transformer to said first and second units, said first and second fan coils, and said thermostat.

11. A control box kit according to claim 3, wherein said first and second fan coils operate simultaneously in all of said pre-selected twinned-unit operating configurations.

12. A control box kit according to claim 2, wherein said first and second units are first and second air conditioning units, said control box kit includes one relay pre-wired with said connection wires inside said control box, and said thermostat is a multi-stage thermostat.

13. A control box kit according to claim 12, wherein said relay and said connection wires are included on a printed circuit board.

14. A control box kit according to claim 2, wherein said first and second units are first and second air conditioning units, said control box kit includes no relays pre-wired with said connection wires inside said control box, and said thermostat is a single-stage thermostat.

15. A control box kit according to claim 1, wherein said preselected twinned-unit operating configurations include:

(a) single-stage operation of said first and second heat pump units;

(b) multi-stage operation of said first and second heat pump units;

(c) single-stage operation of said first and second air conditioning units; and (d) multi-stage operation of said first and second air conditioning units.

16. A control box kit according to claim 15, wherein said first and second fan coils operate simultaneously in all of said pre-selected twinned-unit operating configurations.

17. A control box kit according to claim 1, wherein said first and second units are first and second heat pump units, and said control box kit further includes first, second, and third relays pre-wired with said connection wires inside said control box.

18. A control box kit according to claim 17, wherein said preselected twinned-unit operating configuration includes independent defrost cycles for said first and second heat pump units.

19. A control box kit according to claim 17, wherein said relays and said connection wires are included on a printed circuit board.

20. A control box kit according to claim 17, wherein said thermostat is a single-stage thermostat.

21. A control box kit according to claim 17, wherein said thermostat is a multi-stage thermostat.

22. A control box kit according to claim 1, further comprising first and second auxiliary limit switches in said first and second fan coils, respectively, wherein activation of one of said first and second auxiliary limit switches interrupts power from said transformer to said first and second units, said first and second fan coils, and said thermostat.

23. A control box kit according to claim 1, wherein said first and second fan coils operate simultaneously in all of said pre-selected twinned-unit operating configurations.

24. A control box kit according to claim 1, wherein said first and second units are first and second air conditioning units; said control box kit includes one relay pre-wired with said connection wires inside said control box, and said thermostat is a multi-stage thermostat.

25. A control box kit according to claim 24, wherein said relay and said connection wires are included on a printed circuit board.

26. A control box kit according to claim 1, wherein said first and second units are first and second air conditioning units; said control box kit includes no relays pre-wired with said connection wires inside said control box, and said thermostat is a single-stage thermostat.

* * * * *